US006260314B1

(12) United States Patent
Church et al.

(10) Patent No.: US 6,260,314 B1
(45) Date of Patent: Jul. 17, 2001

(54) EXTENSION PIECE FOR A UTILITY POLE

(75) Inventors: Kenneth S. Church, St. Andrews; Terry Pohjoisrinne, Gimli; Mark Wallace, Gimli; Aaron Lutz, Gimli, all of (CA)

(73) Assignee: Faroex Ltd., Gimli (CA)

( * ) Notice: Subject to any disclaimer, the term of this patent is extended or adjusted under 35 U.S.C. 154(b) by 0 days.

(21) Appl. No.: 09/435,371

(22) Filed: Nov. 8, 1999

(51) Int. Cl.[7] ..... E02D 27/42

(52) U.S. Cl. ..... 52/170; 52/169.13; 52/726.4; 248/523

(58) Field of Search ..... 52/169.13, 170, 52/736.4, 721.5, 726.4, 737.5, 709, 711; 248/518, 523, 530

(56) References Cited

U.S. PATENT DOCUMENTS

| | | | | |
|---|---|---|---|---|
| 1,329,026 | * | 1/1920 | Snyder | 52/170 |
| 2,694,540 | * | 11/1954 | Pfaff, Jr. | 248/514 |
| 3,865,498 | * | 2/1975 | Okuto et al. | 52/726.4 X |
| 4,092,079 | * | 5/1978 | Swanson | 52/726.4 X |
| 4,436,781 | * | 3/1984 | Rother et al. | 52/736.4 X |
| 4,803,819 | | 2/1989 | Kelsey . | |
| 5,571,229 | * | 11/1996 | Fitzsimmons et al. | 52/40 |
| 5,809,733 | * | 9/1998 | Venegas, Jr. | 52/721.5 |
| 5,913,778 | * | 6/1999 | Hying et al. | 52/40 |
| 6,050,034 | * | 4/2000 | Krinner | 52/155 |

* cited by examiner

*Primary Examiner*—Carl D. Friedman
*Assistant Examiner*—Brian E. Glessner
(74) *Attorney, Agent, or Firm*—Adrian D. Battison

(57) ABSTRACT

A pole is mounted in a tubular filament wound support mounted in the ground and supporting the pole standing upwardly therefrom so as to provide an extension for the pole to increase its height or to replace a rotten lower end or to provide an environmentally friendly mounting which avoids toxic preservatives reaching the ground. The tubular body has a hollow interior with one end substantially closed by a dome shaped insert formed during the filament winding process and an opposed open end for receiving a bottom end portion of the pole as a loose fit. A first engagement arrangement on the tubular body is arranged adjacent the open mouth and includes three clamping screws mounted in a reinforcing ring formed by an annular rib of wound filament. A second engagement arrangement on the tubular body spaced downwardly from the first engagement but above the bottom end is formed by an annular rib on the inside surface defining a frusto-conical upper surface extending inwardly to a sharp apex which co-operates with a generally pointed lower end defined by three surfaces cut from the pole and converging toward a lowermost point, each surface being separated from the next by a respective one of a plurality of lines, each line engaging the circular innermost apex so as to hold the pole substantially wedged against movement.

18 Claims, 4 Drawing Sheets

EXTENSION PIECE FOR A UTILITY POLE

This invention relates to an extension piece for a utility pole such as a pole for use in an electricity power transmission line and particularly to an extension piece which engages into the ground and supports the pole extending upwardly therefrom.

BACKGROUND OF THE INVENTION

Conventional utility poles for electricity power transmission lines, street lamps and the like are formed from steel, concrete or wood.

Wooden poles have the advantages that they are natural, of very low cost for relatively short poles and are readily drillable for attachment of various mounting brackets and the like. In addition wooden poles effectively dampen vibration of the pole to resist galloping of the wires caused by vibration at a natural frequency. The wood poles are however relatively weak for the weight of material and have a significant problem with deterioration. The use of preservatives can prevent deterioration but leads to environmental problems. While wooden poles are very hard to displace at short lengths for the significant cost advantages, longer lengths of pole become very expensive due to the unavailability of trees of the required dimensions.

Concrete poles are very strong and relatively flexible but have the significant disadvantage of being very heavy, brittle and difficult to drill. The total cost of an installed pole is also dependent upon the cost of transportation and on site installation of the pole and concrete in view of its great weight significantly increases the costs in these areas.

Steel poles are very strong and flexible but have the significant disadvantages of rusting, high cost and being electrically conductive. This leads to increased costs in relation to the insulators necessary to seperate the power cables from the electrically conductive metal pole.

It has been known for many years, therefore, that there is a significant advantage in utilizing fiber reinforced plastics material for the manufacture of poles of this type. Many attempts have been made to develop poles manufactured from these materials but up till now the only practical pole construction utilized commercially is that manufactured by Shakespeare of Newbury South Carolina which provides a pole for supporting lighting and electrical power cables where the transverse or bending forces on the pole can be significantly increased.

The Shakespeare pole is manufactured by filament winding techniques in which fibers impregnated with resin are wrapped helically around a central mandrel to form a wall thickness of the required amount. The central mandrel is then removed after curing of the resin to leave the finished pole which can then be coated by various techniques to provide an attractive and resistant outer surface.

Various other techniques have been proposed for manufacture of poles for supporting lighting, electric power cables and the like. For proper reinforcement of the pole structure, it is known that both longitudinal and transverse fibers are required. A number of techniques are proposed for providing such arrangement of fibers. Pultrusion is a well known technique in which parts are formed of a constant cross section by drawing through a dye resin impregnated fibrous materials which are continuous along the length of the structure. The majority of the fibers in such a structure are longitudinal but some transverse fibers can be added by the addition of various types of mat which has the combination of longitudinal and transverse fibers. One example of a pole of this type is shown in U.S. Pat. No. 4,803,819 (Kelsey) and described in a paper dated 1987 relating to a product designed by 3-P Industries Inc. of Toms River N.J. This arrangement provides a pole of constant transverse cross section which is an essential result of the pultrusion process. In order to provide the required structural strength for this pole, a complex cross section is necessary including transverse webs both internally and externally of a main longitudinal cylindrical shape of the pole. It is understood that this arrangement has not achieved significant commercial success. The constant cross section of pultruded poles of this type is unsatisfactory since it does not maximize the strength to weight characteristics and since the constant cross section thus formed is significantly less resistant to damaging vibrations than are tapered poles. In addition the limited amount of transverse fibers that can be included significantly reduces the resistance of the pole to transverse collapse thus requiring the complex transverse elements of the cross section which are difficult and expensive to manufacture.

Filament winding provides another technique for providing both the longitudinal and transverse fibers. In this technique the fibers are wound helically about the central axis of the pole. It is of course possible to control the helix angle so that at some point along the length of the pole the helix angle is very shallow that is close to 90° to the axis. At other points along the length of the pole, the helix can be stretched out to approximate to longitudinal fibers. However it is certainly not possible to apply such fibers directly longitudinally since it is necessary to maintain some degree of helix angle to hold the fibers in place on the structure. It will be appreciated that complex computer control of the winding can be effected both in relation to the helix angle and the reversal points of the helix to maximize structural strength. In addition the shape and wall thickness of the pole can be varied again to maximize strength both in relation to the taper of the pole and the thickness of the wall of the pole at various positions along the length of the pole. This arrangement is shown in a catalogue of Shakespeare which shows the various products available. A further example is shown in a paper published in October 1980 which refers to a pole of this type manufactured by W.J. Whatley Inc. of Commerce City Colo.

Up till now the manufacture of poles from composite materials, apart from the limited success of the Shakespeare pole, has not lead to commercial acceptance. The relatively high cost of the composite material related to the availability, low cost and acceptance of the wooden pole has prevented the composite pole from replacing the wooden pole.

Some attention has therefore been given to manufacturing extension pieces which are mounted on the top of the pole. The extension pieces are conventionally manufactured from composite materials using various techniques and are attached to the top of the wooden pole. However, this technique does not overcome the environmental problem of wooden poles. In addition, the mounting of an extension piece at the top of the pole is limited in that the basic strength of the pole is determined by its thickness and density of its base so that a pole having a pre-determined thickness at the base cannot be extended beyond a pre-determined limit without exceeding the strength of the base and thus overloading the pole beyond its capabilities.

In addition, wooden poles have a tendency to rot at the base, particularly in ground conditions of heavy moisture. Some attempts therefore have been made to provide additional support at the base by driving stakes into the ground around the base of the pole and attaching the pole to the stakes.

A further technique involves a provision of concrete sleeves which are embedded in the ground and the pole carried in the sleeve supported by aggregate located between the sleeve and the pole.

However, all of these procedures have limitations and have not been able to solve the basic environmental problems of wooden poles

SUMMARY OF THE INVENTION

It is one object of the present invention to provide a support for a utility pole which allows the utility pole formed of wood to be raised up from engagement with the ground.

According to the invention, therefore, there is provided a pole support member for mounting in the ground and receiving and supporting a pole standing upwardly therefrom comprising:

a tubular body having a hollow interior with one end substantially closed and an opposed open end and arranged for mounting in the ground with the substantially closed end facing downwardly and the open end facing upwardly for receiving a bottom end portion of the pole as a loose fit therein inserted through the open end into the hollow interior;

a first engagement arrangement on the tubular body adjacent the open mouth for engaging and locating the pole at a first position thereon;

a second engagement arrangement on the tubular body spaced downwardly from the first engagement arrangement for engaging and locating the pole at a second position thereon such that the pole is supported in the tubular body and is held against movement relative thereto;

the tubular body being formed from a set resin material reinforced by a plurality of helically wrapped filaments.

Preferably the second engagement arrangement comprises an annular restriction member projecting inwardly from a wall of the tubular body into the interior and defining a circular innermost portion for surrounding and engaging the pole.

Preferably the annular restriction member has a frustoconical upper surface

Preferably the annular restriction member has upper and lower surfaces converging to an apex at the circular innermost portion.

Preferably the annular restriction member is formed integrally with the tubular body from the set resin material and from circumferentially wrapped reinforcing filaments.

Preferably the annular restriction member is arranged at a position spaced from the lower closed end such that the pole can include a portion projecting through the annular restriction member toward the lower end.

Preferably the first engagement arrangement comprises a mounting ring adjacent the open end of the tubular member and a plurality of clamping screws carried on the mounting ring and extending therefrom inwardly for clamping engagement with the pole, the clamping screws being carried in threaded openings provided in the mounting ring such that rotation of each clamping screw about its axis moves the clamping screw toward the pole.

Preferably each screw carries an abutment plate for engaging the pole.

Preferably the second engagement arrangement comprises a fixed wedge member against which a bottom end of the pole abuts.

Preferably the ring member is formed integrally with the tubular member and is formed by the set resin material and reinforcing fibers wound circumferentially.

Preferably the ring member includes a plurality of metal inserts each for threadedly engaging a respective one of the clamping screws.

Preferably the ring member includes a metal band embedded therein.

Preferably each metal insert comprises a cylindrical member inserted in a drilled hole in the ring member.

Preferably the lower end is closed by a dome member defined by a dome wall having a concave surface on one side and a convex surface on the other side, the dome wall being formed from set resin material reinforced by filaments spanning the dome member.

Preferably the dome member is separate from and attached to the tubular member.

Preferably the dome member is attached to the tubular member so as to be received into the lower end with the concave surface facing downwardly.

Preferably the dome member includes an annular groove for receiving and engaging the lower end of the tubular body.

Preferably the dome member includes a central hole.

Preferably there is provided an extraction tube for removing liquid collecting between the pole and the interior of the tubular body, the tube passing through the central hole.

Preferably there is provided an extraction tube for removing liquid collecting between the pole and the interior of the tubular body, the tube passing through the open end of the tubular body.

According to a second aspect of the invention there is provided a combination comprising:

a pole;

a support member mounted in the ground and supporting the pole standing upwardly therefrom, the support member comprising:

a tubular body having a hollow interior with one end substantially closed and an opposed open end and arranged for mounting in the ground with the substantially closed end facing downwardly and the open end facing upwardly for receiving a bottom end portion of the pole as a loose fit therein inserted through the open end into the hollow interior;

a first engagement arrangement on the tubular body adjacent the open mouth for engaging and locating the pole at a first position thereon;

a second engagement arrangement on the tubular body spaced downwardly from the first engagement arrangement for engaging and locating the pole at a second position thereon such that the pole is supported in the tubular body and is held against movement relative thereto;

the pole having a generally pointed lower end defined by a plurality of surfaces cut from the pole and converging toward a lowermost point, each surface being separated from the next by a respective one of a plurality of lines;

wherein the second engagement arrangement comprises an annular restriction member projecting inwardly from a wall of the tubular body into the interior and defining a circular innermost portion lying in a horizontal plane surrounding and engaging the pole, each line engaging the circular innermost portion so as to hold the pole substantially wedged against movement.

An insert of this type can be used with wooden utility poles and have the following advantages:

A: It can be used for broken or rotten pole replacement in that the broken or rotten end can be cut off and the freshly formed bottom inserted into the top end of the tubular body of the support member.

B: The support can be used to raise the pole to a higher level should this be required in particular circumstances. As the lower end of the complete pole structure provided by the combination of the support member and the pole is then defined by the support members of the pole itself, the strength of the support member defines the strength of the base and of the strength of the combination. The support can be formed in a manner which provides sufficient strength to exceed the normal wooden pole strength and thus increase the classification of the pole to an improved level.

C: The support has the advantage that it engages into the ground and lifts the bottom end of the pole upwardly from the ground and provides a container for the bottom end. There is a reduced necessity therefore to provide preservatives in the wood since the wood is supported away from the moisture in the ground. In addition, the reduced amount of preservative necessary is also held away from the ground and is prevented from penetrating into the ground.

BRIEF DESCRIPTION OF THE DRAWINGS

One embodiment of the invention will now be described in conjunction with the accompanying drawings in which.

DETAILED DESCRIPTION

Figure 1:
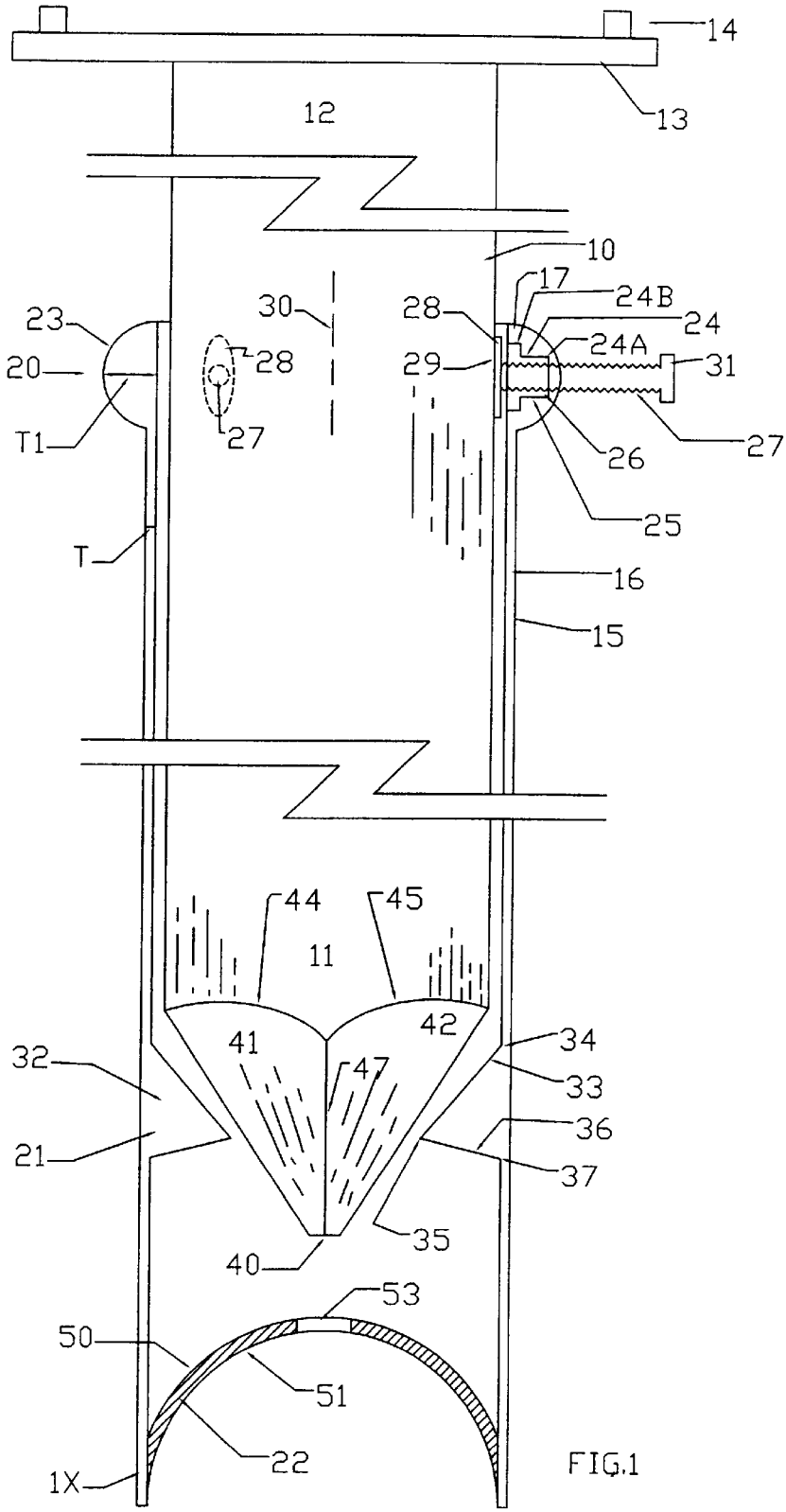
FIG. 1 is a vertical cross-sectional view of a utility pole, for an electric power transmission line, including a ground support member according to the present invention.

A conventional wooden pole indicated at 10 having a bottom end 11 and a top end 12. At the top end is attached suitable support arms 13 for carrying a utility schematically indicated at 14 generally in the form of electric or other transmission wires which are strung from one pole to the next. The bottom end 11 of the pole is mounted in a pole support or extension piece 15. The pole support 15 comprises a tubular body 16 extending from an upper edge 17 to a lower edge 18 and defining a tubular wall between the upper and lower edges.

In the embodiment shown, the tubular body is cylindrical of constant diameter from the upper edge 17 to the lower edge 18. However the tubular body may also be tapered so that its diameter increases either upwardly or downwardly depending upon requirements. In general the change in diameter will be relatively small so that the tubular member closely surrounds the pole but is spaced from the pole sufficiently to allow the pole to fit in with a small clearance. The support may be tapered particularly when of long length so as avoid the complete structure having a natural frequency of vibration which could cause galloping of the power wires supported by the pole.

The tubular body includes a first pole engagement member 20 at or adjacent the upper edge 17 and a second pole engagement member 21 spaced downwardly from the upper edge 17 and upwardly from the bottom edge 18.

In general the engagement members 20 and 21 engage or clamp the pole to define a clamp portion within the tubular body. The clamp portion from the upper edge 17 to the second engagement member 21 has sufficient length to transmit loads from the pole to the support member. The support member is mounted into the ground to a depth sufficient to transmit the loads from the support member to the ground. In general the approximate length of the support member will be in the range 6 to 50 feet depending upon the requirement to raise the pole height and the distance from the upper clamping member 20 to the lower clamping member 21 will be of the order of 4 to 7 feet, that is based upon a rough calculation of 10 percent of the pole length plus 2 feet.

The tubular member is manufactured so that the diameter is slightly greater than that of the pole. Conventionally poles have the diameter of the order 12 to 36 inches and therefore a number of different diameter of support members can be manufactured to accommodate different diameters of pole, generally in 2 inch increments. A spacing between the pole and the support of greater than 1.5 inches (that is a difference in diameter of 3 inches) is not preferred and generally the spacing is maintained at the order of 1 inch.

The lower end of the tubular body is closed by an end plug 22 so that when inserted into the ground soil is prevented from entering the lower end over time which would allow the structure to sink in the soil. The location of the lower engagement 21 is arranged so it is spaced upwardly from the plug 22 and prevents a lower end of the pole from interfering with or engaging the plug and thus not properly seating in the engagement 21 as described herein after.

The first engagement 20 comprises a raised rib 23 formed on the wall 16 so as to form a portion of increased thickness T1 relative to the thickness T of the wall. The rib 23 is arranged substantially immediately adjacent to the edge 17 so as to merge with the edge 17. The rib is drilled at six locations to form receptacle bores 24 for six insert members 25. Each bore 24 includes a first bore 24A and a second larger counter bore 24B so as to receive an insert member have a cylindrical body inserted into the bore 24A and a head inserted into the bore 24B. The insert is formed of metal and has a threaded bore 26 through the insert member for receiving a threaded clamping screw 27. An abutment plate 28 is provided on the inner end of the screw 27 for engaging the outside surface 29 of the pole. The location of a central axis 30 of the pole can thus be adjusted by actuating the three of the six screws 27 by a suitable actuating head 31. The pole can thus be adjusted so that it can stand vertically upwardly from the support member. After adjustment, the three additional screws can be moved into a clamping position to assist in holding the clamped pole in the set vertical position.

The second or lower engagement member 21 comprises an inwardly extending restriction body 32 integrally formed with the wall 16 and extending therefrom inwardly for engagement with a lower end of the pole 11. The restriction 32 has an upper surface 33 which is frusto-conical extending from an intersection 34 with the wall 16 to a circular inner apex 35. The restriction further has a lower wall 36 which extends downwardly and outwardly from the apex 35 to an intersection 37 with the wall 16. The apex 35 thus forms a circle surrounding a central axis of the tubular member. The apex is preferably therefore sharp or formed by a relatively small radius of curvature so as to provide an abutment edge for engaging the pole.

Figure 2:
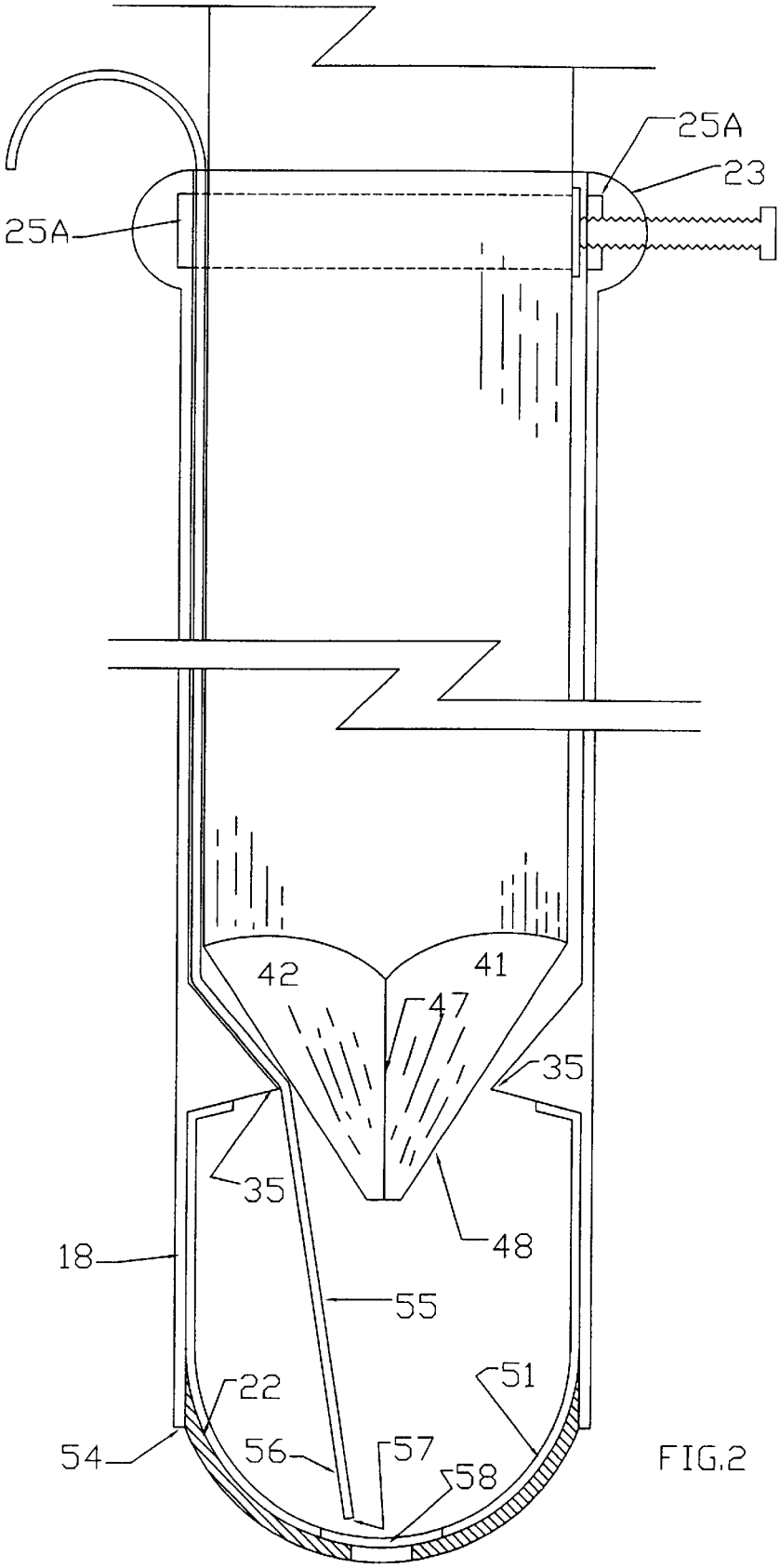
FIG. 2 is a similar cross-sectional view to that of FIG. 1 taken at an angle relative to that of FIG. 1 and showing a second embodiment according to the present invention.
Figure 3:
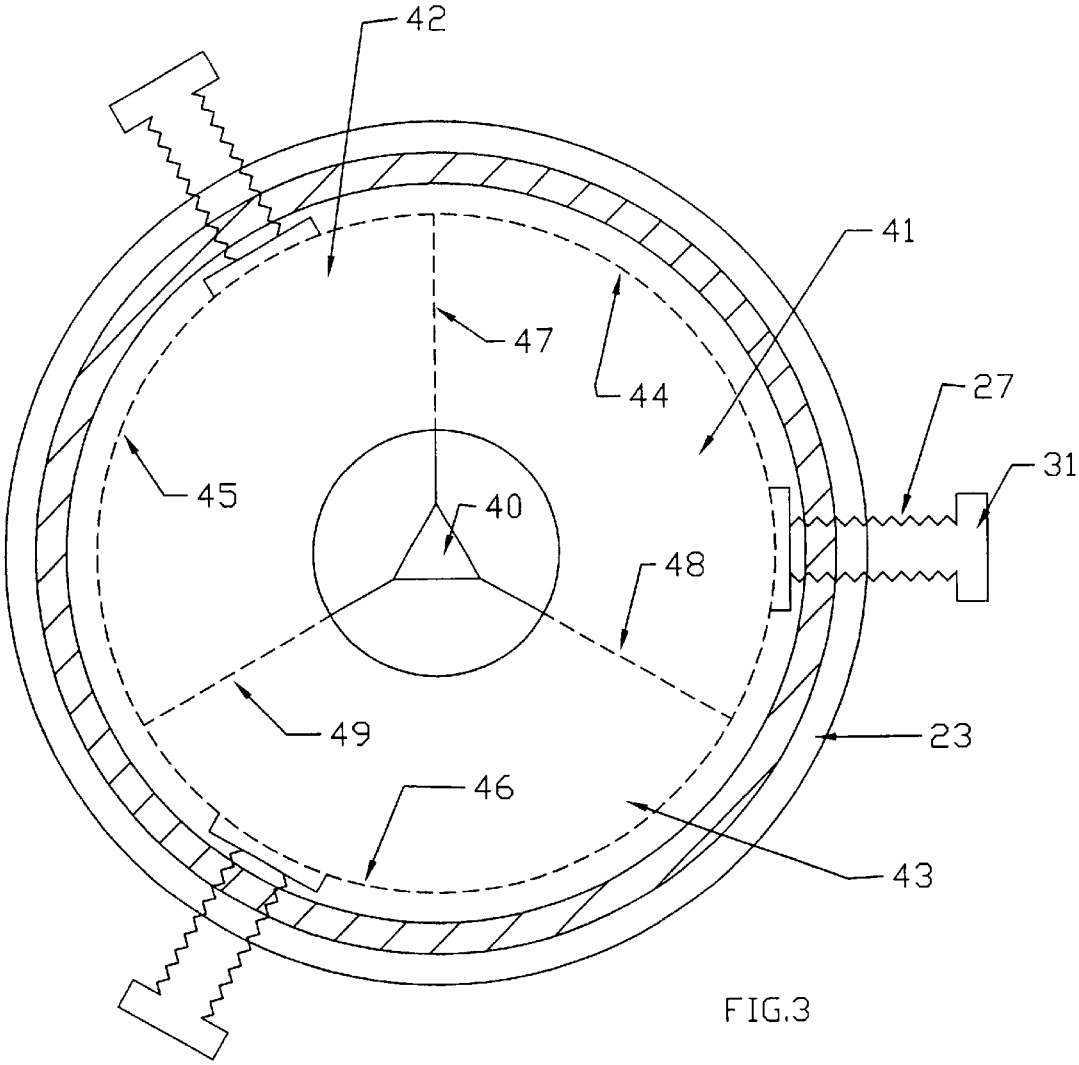
FIG. 3 is a cross sectional view along the lines 3—3 of FIG. 1.

The pole is cut to form a lower most apex 40 which is pointed or relatively small and to define three cuts planes 41, 42 and 43. These cuts are arranged approximately at 120 degrees spacing around the pole and at an angle to the axis 30 if the pole so that each cut plane extends from the apex 40 upwardly and outwardly to a line 44, 45, 46 of intersection with the generally cylindrical outside surface of the pole. The cut line each therefore defines an arched edge at the surface of the pole. The cut lines meet at edges 47, 48 and 49. The cut planes are preferably formed simply by a chainsaw or a similar portable cutting device so that the cut planes are not necessarily accurate to the required angle and don't necessarily have the same angle to the axis. However, because there are three planes, there are three straight lines 47, 48 and 49 which extend generally from the outer cylindrical service of the pole towards the apex 40. These lines thus intersect with the apex 35 and thus hold the lower end of the pole in a fixed position. As shown in FIG. 2 one of the lines 48 is in engagement with the apex 35. At the diametrically opposed position, the plane 42 is spaced away from the apex 35.

The pole is thus held in place by engagement with the lower engagement 21 and by adjustment at the upper engagement 20.

The lower end of the tubular body is closed by the bottom cap 22 so that soil is prevented from entering the tubular member.

The end cap 22 is dome shaped with an outer convex surface 50 and an inner concave surface 51. The end cap also has a central hole 53. In the embodiment showed in FIG. 1, the end cap is mounted onto the lower end 18 so that it extends inwardly into the lower end with the concave surface 51 facing downwardly. A groove is formed around the outer surface 50 so as to receive and engage the end face of a tubular body at the end 18. The end cap is fixed in place by adhesive so it remains fixed into the end wall of the tubular body.

In FIG. 2 is shown a slightly modified arrangement having a number of differences from the arrangement of FIG. 1. A first difference is that the individual screw mounts 25 are replaced by a cylindrical band 25A which is embedded within the rib 23 and surrounds the pole at the rib. This arrangement therefore provides additional strength for mounting the screws 27 as previously described.

A further modification is that the end cap 22 is attached to the lower end 18 in an orientation which is inverted as to the arrangement of FIG. 1 so that the concave surface 51 faces upwardly and the convex surface 50 faces downwardly. Further in this embodiment the hole 53 is covered by a closure seal or sealing bag 58 which prevents moisture collected within the lower end of the tubular body from escaping into the surrounding soil.

An extraction tube 55 is provided with a lower end 56 which engages into the end cap so that an innermost end 57 of the tube can be used to extract any liquid collecting in the bottom of the tubular body. Such liquid generally will be formed by rainwater or other moisture running down the pole and engaging into the tubular body in the space between the body and the pole. Such liquid may contain preservatives from the wood or other contaminants and therefore it is in desirable that the materials do not escape into the surrounding soil so they are collected within the bottom end of the tubular body and can be extracted periodically by sucking through the tube 55 from an upper end of the tube exposed above the ground. The tube 55 extends through the inside of the tubular body into the space between the surface 42 and the apex 35 and passes along the space between the pole and the inside surface of the tubular body to emerge through the open upper end of the tubular body.

Further modifications can be provided but are not shown. For example, in the embodiments described above, the tubular body is of a circular cylindrical shape. However the tubular body may be tapered so that the diameter increases or decreases so as to accommodate poles of differing shapes.

Furthermore the surfaces 33 and 33 may be curved and the apex 35 may be of increased radius of curvature so that the restriction 21 is formed of a generally smooth or curved collar or rib formed on the inside of the tubular member.

Figure 4:
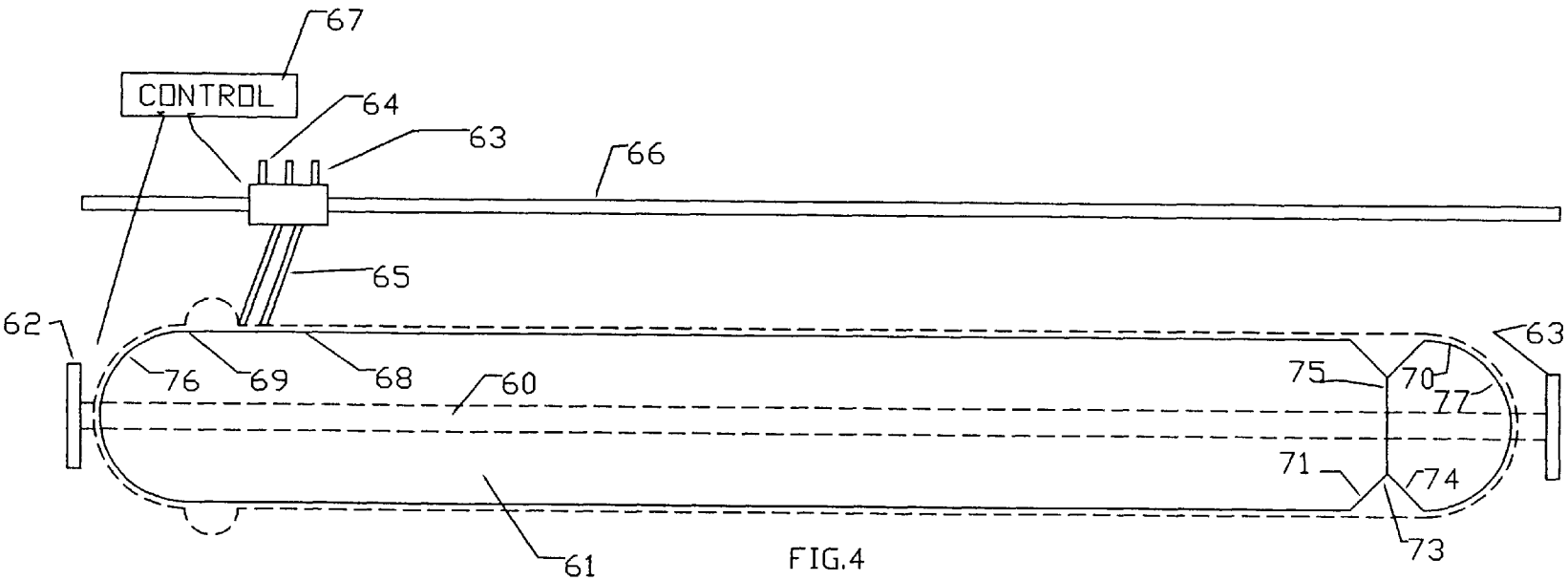
FIG. 4 is a schematic side elevational view showing a method of manufacturing the support member of FIG. 1.

Turning now to FIG. 4, there is shown a method for manufacturing the tubular member described above. The method comprises providing a support shaft 60 on which is mounted a mandrel 61 shaped to define the required inside surface of the tubular body. The mandrel is attached to the shaft so it can be rotatable therewith. The shaft 60 is mounted in supports 62 and 63, one of which is arranged to drive the shaft in rotation about its axis so as to rotate the mandrel. A filament supply system 63 carries a plurality of filament supply bobbins 64 so to supply a series of filaments 65 in parallel side by side fashion. Supply system 63 is mounted on a track 66 so that the supply 63 can be moved longitudinally of the mandrel. A numerical control system 67 provides control information to the filament supply and to the drive system to the mandrel so that the filaments can be applied onto the outside service of the mandrel at required locations and at required angles selected to the longitudinal axis of a shaft 60.

The filaments carry a settable resin so that the resin is applied onto the outside surface of the mandrel simultaneously with the filament the alternative, the filaments can be wound dry and infused with a settable resin. When the winding is complete, the resin is arranged to set so that the structure is completed.

The system described above uses conventional techniques of filament winding which are well known to one skilled in the art and therefore further detail of the structure of the components necessary for carrying out the system and further details of the type of filaments is not necessary herein.

The mandrel 61, in order to provide the required shape for the inside surface of the tubular body has a generally cylindrical main body part 68 extending from the first end 69 of the cylindrical part to a second end 70 of the cylindrical part. The only divergence from the cylindrical wall is provided by an annular recess 71 shaped to define the inside surface of the projection 32. The recess defines surfaces 73 and 74 matching the surfaces 33 and 36 of the projection 32. The surfaces converge to an apex 75 matching the apex 35.

Beyond each edge 60, 70 the mandrel is shaped to define a domed outer surface 76, 77 forming a hemispherical section or a section which is generally arched.

The winding of the filaments of the mandrel is effected so that, after winding a first wrap of filaments lying at substantially zero degrees, the filaments lie at a shallow angle to the axis along most of the structure. Preferably the angle lies in the range 5 to 20 degrees to the axis. Thus the filaments are wrapped helicaly around the mandrel through a number of turns through each pass along the length of the mandrel and at the end the filaments wrap over the domed section so that the filaments on the domed section wrap around the dome section approximately along a diameter of the dome section so that the filaments remain stable on the dome section without the tendency to slip off the dome section to either side. The filaments wrap around the shaft so the filaments pass on either side of the shaft leaving a hole at the shaft so that the filaments wrap back and forth so to repeatedly cover the outside surface of the mandrel. The filaments are wrapped generally helically that is without longitudinal translation to form the rib 23 and to form the projection 32. Thus the main body of the tubular member is formed from primarily longitudinally and the body is reinforced at the upper end by the rib 23 from helical fibers and by the projection 32 again from helical fibers.

When the winding is complete and the resin is set, the tubular body is cut at the edges 69 and 70 so to remove the domed end section. The mandrel 61 is formed in two sections split at the apex 75 so that one section can be pulled out through the right hand end and the other section pulled out from the left hand end and the shaft removed. One of the end dome sections cut from the tubular member is then used as the end cap 22 after shaping to form the mounting groove 54. The hole 53 is automatically formed by the shaft 60.

Since various modifications can be made in my invention as herein above described, and many apparently widely different embodiments of same made within the spirit and scope, it is intended that all matter contained in the accompanying specification shall be interpreted as illustrative only and not in a limiting sense.

What is claimed is:

1. A combination comprising:

a wooden utility pole having a tapered bottom end portion converging substantially to a pointed bottom apex;

a pole support member for mounting in the ground and receiving and supporting the wooden utility pole standing upwardly therefrom, the support member comprising.

a tubular body having a hollow interior with a lower end substantially closed and an opposed open upper end and arranged for mounting in the ground with the substantially closed end facing downwardly and the open end facing upwardly receiving a bottom end portion of the wooden utility pole as a loose fit therein inserted through the open end into the hollow interior;

a first engagement arrangement on the tubular body adjacent the open mouth engaging and locating the pole at a first position thereon;

wherein the first engagement arrangement comprises a mounting ring attached to the tubular body adjacent the open end of the tubular body and a plurality of clamping screws carried on the mounting ring and extending therefrom inwardly to an inner end thereof in clamping engagement with an outside surface of the pole, the clamping screws being carried in threaded openings provided in the mounting ring such that rotation of each clamping screw about its axis moves the inner end of the clamping screw toward the pole;

a second engagement arrangement on the tubular body spaced downwardly from the first engagement arrangement engaging and locating the pole at a second position thereon such that the pole is supported in the tubular body and is held against movement relative thereto;

the second engagement arrangement comprising an annular restriction member projecting inwardly from a wall of the tubular body into the interior and defining a circular innermost portion surrounding and engaging the tapered bottom end portion of the pole at a position above the bottom apex;

the tubular body including the mounting ring and the annular restriction member being formed integrally from a set resin material reinforced by a plurality of wrapped filaments.

2. The pole support member according to claim 1 wherein the annular restriction member has a frusto-conical upper surface.

3. The pole support member according to claim 1 wherein the annular restriction member has upper and lower surfaces converging to an apex at the circular innermost portion.

4. The pole support member according to claim 1 wherein each screw carries an abutment plate engaging the pole.

5. The pole support member according to claim 1 wherein the ring member includes a plurality of metal inserts each threadedly engaging a respective one of the clamping screws.

6. The pole support member according to claim 1 wherein the ring member includes a metal band embedded therein.

7. The pole support member according to claim 5 wherein each metal insert comprises a cylindrical member inserted in a drilled hole in the ring member.

8. The pole support member according to claim 1 wherein the lower end is closed by a dome member defined by a dome wall having a concave surface on one side and a convex surface on the other side, the dome wall being formed from set resin material reinforced by filaments spanning the dome member.

9. The pole support member according to claim 8 wherein the dome member is separate from and attached to the tubular member.

10. The pole support member according to claim 9 wherein the dome member is attached to the tubular member so as to be received into the lower end with the concave surface facing downwardly.

11. The pole support member according to claim 9 wherein the dome member includes an annular groove for receiving and engaging the lower end of the tubular body.

12. The pole support member according to claim 8 wherein the dome member includes a central hole.

13. The pole support member according to claim 12 wherein there is provided an extraction tube for removing liquid collecting between the pole and the interior of the tubular body, the tube passing through the central hole.

14. The pole support member according to claim 1 wherein there is provided an extraction tube for removing liquid collecting between the pole and the interior of the tubular body, the tube passing through the open end of the tubular body.

15. A combination comprising:

a wooden utility pole;

a support member supporting the pole standing upwardly therefrom and arranged for mounting in the ground, the support member comprising:

a tubular body having a hollow interior with one end substantially closed and an opposed open end and arranged for mounting in the ground with the substantially closed end facing downwardly and the open end facing upwardly receiving a bottom end portion of the pole as a loose fit therein inserted through the open end into the hollow interior;

a first engagement arrangement on the tubular body adjacent the open mouth that engages and locates the pole at a first position thereon;

a second engagement arrangement on the tubular body spaced downwardly from the first engagement arrangement that engages and locates the pole at a second position thereon such that the pole is supported in the tubular body and is held against movement relative thereto;

the pole having a generally pointed lower end portion defined by a plurality of planar surfaces arranged angularly spaced around an axis of the pole and converging toward a lowermost point, each planar surface being separated from the next planar surface by a respective one of a plurality of lines angularly spaced around the axis of the pole;

wherein the second engagement arrangement comprises an annular restriction member projecting inwardly from a wall of the tubular body into the interior and defining a circular innermost portion lying in a horizontal plane surrounding and engaging the lower end portion of the pole, each line of the lower end portion engaging the circular innermost portion of the annular restriction member so as to hold the lower end portion of the pole substantially wedged against sideways movement.

16. The combination according to claim 15 wherein the annular restriction member has a frusto-conical upper surface.

17. The combination according to claim 15 wherein the annular restriction member has upper and lower surfaces converging to an apex at the circular innermost portion.

18. The combination according to claim 15 wherein the annular restriction member is formed integrally with the tubular body from a set resin material and from circumferentially wrapped reinforcing filaments.

* * * * *